United States Patent [19]

Romer et al.

[11] Patent Number: 4,608,927

[45] Date of Patent: Sep. 2, 1986

[54] SEGMENTED SABOT

[76] Inventors: Rudolf Romer, Roseggerstrasse 3, Kaarst; Juergen Boecker, Am Wall 15, Oberhausen; Klaus W. Klein, Lahnstrasse 10, Neuss; Klaus Gersbach, Friedrichstrasse 5, Willich; Jürgen Winkelmann, Industriestrasse 86, Kaarst; Winfried Rossmann, Benzstrasse 10, Neuss, all of Fed. Rep. of Germany

[21] Appl. No.: 603,131

[22] Filed: Apr. 23, 1984

[30] Foreign Application Priority Data

Apr. 23, 1983 [DE] Fed. Rep. of Germany ..... 3314749

[51] Int. Cl.[4] ..... F42B 13/16

[52] U.S. Cl. ..... 102/521

[58] Field of Search ..... 102/520–523

[56] References Cited

U.S. PATENT DOCUMENTS

| | | | |
|---|---|---|---|
| 3,164,092 | 1/1965 | Reed et al. | 102/522 |
| 4,249,465 | 2/1981 | Ballmann | 102/520 |
| 4,326,464 | 4/1982 | Price | 102/523 |
| 4,372,217 | 2/1983 | Kirkendall et al. | 102/521 |

FOREIGN PATENT DOCUMENTS

| | | | |
|---|---|---|---|
| 86711 | 8/1983 | European Pat. Off. | 102/521 |
| 3033041 | 3/1982 | Fed. Rep. of Germany | 102/522 |

*Primary Examiner*—Harold J. Tudor

[57] ABSTRACT

A sabot consists of a plurality of segments which define an air pocket for detaching the segments from a fin-stabilized subcaliber penetrator projectile. The air pocket is defined by a rear support region of the sabot. A front support region of the sabot includes a plurality of webs between each adjacent pair of which an air-through-streaming passage is defined. At least the web portion of each segment is made of synthetic material and such web portion has a curved part defining a fracture zone.

6 Claims, 3 Drawing Figures

SEGMENTED SABOT

BACKGROUND OF THE INVENTION

The invention relates to a segmented sabot of the type disclosed in U.S. Pat. No. 3,620,167 which sabot is used in conjunction with a subcaliber projectile. Such segmented sabot is mounted on a subcaliber projectile in a manner which provides for the formation in the vicinity of the front of the projectile of an air dam which is situated at the region of the projectile on which the front part of the sabot is mounted. The sabot also is mounted on the projectile with a rear portion which has a rear edge about which the separation of the segments on the projectile (often referred to as "penetrator"), is effected. The detachment of the sabot segments from the penetrator body has been found to be frequently uneven. This can lead to undesirable oscillations of the projectile. Such oscillations of the projectile can detract from its target-impact-accuracy as well as its penetration capability. This is particularly significant in connection with the new types of targets, against which particularly long projectiles must be used which projectiles must also be as completely as possible free of any kind of oscillations during their trajectory. Test regarding the flight-behavior of projectile-sabot-arrangements have shown that, in the region of the front portion of the penetrator body (projectile), there may occur unstable streaming conditions which inhibit the uniform segment-detachment of the segmented sabot.

SUMMARY OF THE INVENTION

It is an object of this invention to provide a segmented sabot of the afore-described type wherein the segment-detachment is not influenced by so-called pressure fluctuations and thereby the manner of detachment becomes more uniform.

BRIEF DESCRIPTION OF THE DRAWINGS

With these and other objects in view, which will become apparent in the following description, the present invention, which is shown by example only, will be clearly understood in connection with the accompanying drawing, in which.

DETAILED DESCRIPTION

Figure 1:
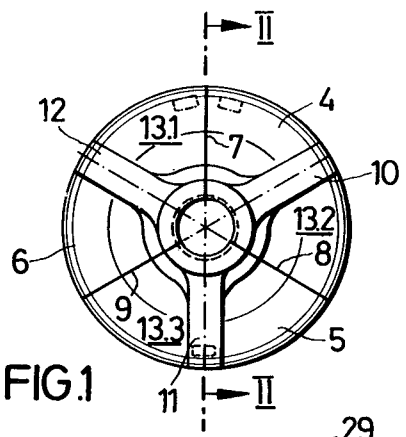
FIG. 1 is a front-elevational view of a first embodiment of a segmented sabot in accordance with the invention.
Figure 2:
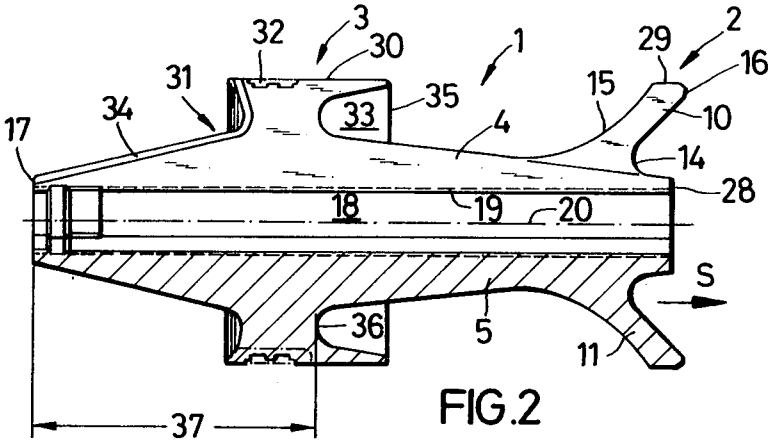
FIG. 2 is a side-elevational view, partially in section, along line II—II of FIG. 1.

In the segmented sabot according to the first embodiment of FIGS. 1 and 2 there is illustrated a sabot 1 having a front support region 2 and a rear support region 3, which sabot consists of three segments 4, 5 and 6. The respective adjoining sabot segments 4, 5 and 6 are separated from each other by joints 7, 8 and 9. The forward support region 2 consists of three web members 10, 11 and 12. These members are, however, at their front side defined by a curved surface 14 and at their rear side by a curved surface 15 and are in the direction of firing (indicated by the arrow S in FIG. 2) inclined towards a central longitudinal axis 20 and have a narrow forward end face 16 and an outer bearing support surface 29.

Along the longitudinal axis 20 there extends a cylindrical central bore 18 for accommodating a non-illustrated penetrator projectile that extends at least from the rear rear sabot end 17 to the forward end 28 of the sabot 1. The bore 18 has peripheral form-locking means 19 which coact with corresponding form-locking means on the non-illustrated penetrator projectile. The rear support region 3 encompasses with a closed cylindrical peripheral surface 30 the longitudinal axis 20 and has in its outer peripheral region an annular recess 32 for accommodating therein a non-illustrated sealing band. The rear support region 3 is defined at its forward side with an edge 35 which defines partially an air pocket 33 that has a base surface 36 and at its rear is defined by gas pressure receiving surface 31, which in the region of each of the joints 7, 8 and 9 has a corresponding groove 34 for receiving therein a non-illustrated sealing element.

When the sabot 1, which form-lockingly encompasses the subcaliber penetrator projectile, leaves the muzzle of a non-illustrated gun barrel in the direction of the arrow S, the air streaming therepast through the intermediate space 13.1, 13.2 and 13.3 reaches the air pocket 33 and thereby initiates the detachment of the segments 4, 5 and 6 from the penetrator projectile body. It has proven to be advantageous that a lever arm 37, which extends from the rear edge 17 up to the base surface 36 of the air pocket 33 (acting as a rolling-off edge relative to the penetrator projectile body which can be favored by a corresponding projection of the penetrator body) is relatively short and the detachment of the segments 4, 5 and 6, due to the large distance from the nose point of the penetrator projectile, is not inhibited by the pressure fluctuations in the forward region. As a result of the relatively reduced mass of the corresponding segments 4, 5 and 6 there results additionally a substantially reduced shock effect on the projectile body, which thereby advantageously leads to reduced oscillations.

Figure 3:
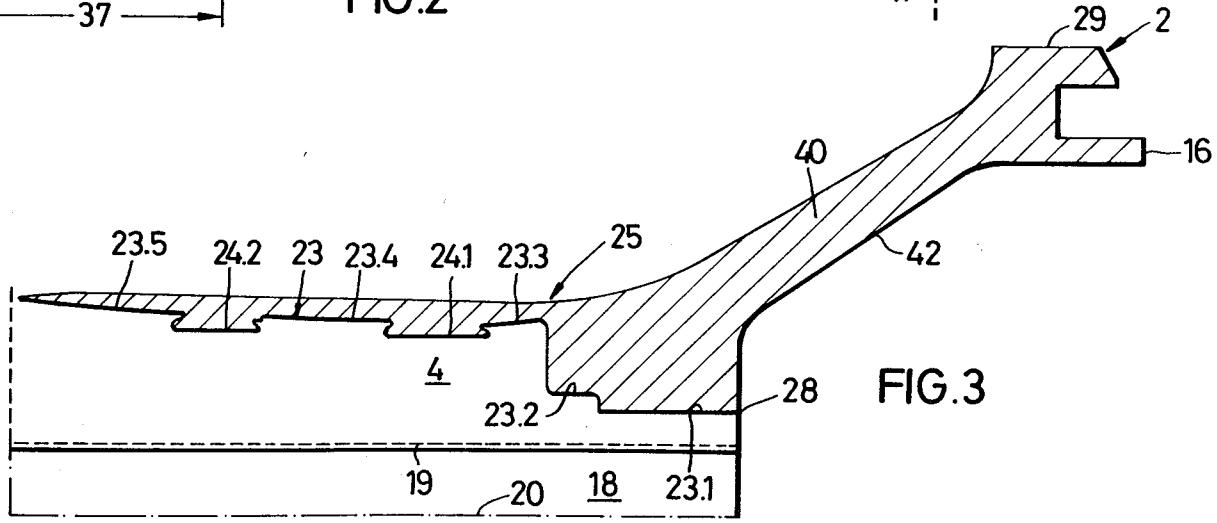
FIG. 3 is a longitudinal section through the front region of a segment of a sabot according to a second embodiment of the invention.

A second embodiment of such a sabot is illustrated in FIG. 3 wherein the web members, of which only one web 40 is illustrated, is at its front defined by a comparatively wider surface 42, which consequently offers a greater resistance to the thereagainst streaming air. The webs are made of synthetic material of reduced density. A not further designated main portion is made of a light metal alloy and has an inner surface 23 formed by several segments 23.1 to 23.5 which define two dovetailed grooves 24.1 and 24.2. The web 40 is made out of synthetic material and has mating dove-tailed projections which are slid into the dove-tailed ridges 24.1 and 24.2. A region of reduced cross-section of the web 40 is formed as a fracture zone 25.

When the non-illustrated projectile with segmented sabot in accordance with FIG. 3 leaves the muzzle of a gun barrel the webs 40 are pressure-loaded in the region of the surfaces 42 by the air streaming thereagainst and fracture at the fracture zones 25. A further detachment then occurs substantially in the same way as has been described in connection with the first embodiment. By means of a non-illustrated configuration of the gas pressure receiving surface at the sabot the detachment of the segments from the penetrator projectile body can also be initiated from the rear or also along a substantially parallel plane with respect to the longitudinal projectile axis.

Whereas in the embodiment according to FIG. 3 the webs 40 are manufactured and illustrated to be made out of synthetic material, this can also be applicable, at least partially, with respect to the not further designated main portion of the corresponding segments. This applies also to the embodiment according to FIGS. 1 and 2, whereby a fracture zone 25 in FIG. 3 has its corresponding zone in the embodiment of FIGS. 1 and 2 which has not been designated but which can, for example, be in the region of the curved surface 14.

The above-described segmented sabots are to be used with sub-caliber penetrator projectiles having a length to diameter ratio in the range of 10/1 to 30/1.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. A sabot for use on a penetrator projectile normally fired from a gun barrel in a longitudinal firing direction, the sabot being segmented and formed with:

a body of an outer diameter substantially smaller than the caliber of the gun barrel, adapted to fit snugly around the penetrator projectile, and having relative to the firing direction a front end and a rear end;

a plurality of radially spaced support webs projecting radially from the front end of the body and having respective outer surfaces engageable with the barrel to center the front end therein, the webs defining longitudinally open gaps through which air can stream longitudinally back between the webs against the firing direction when the sabot and projectile are fired in this direction; and a rearward centering ridge projecting radially from the body longitudinally behind the webs and having an outer surface engageable with the barrel to center the rear end therein, the ridge having angularly continuous and defining a forwardly concave and open air-receiving pocket between its outer surface and the body, whereby air streaming back against the direction between the webs is trapped in the pocket.

2. The sabot defined in claim 1 wherein the body, ridge, and webs are segmented along longitudinal joints and each segment of the sabot has a single such web.

3. The sabot defined in claim 1 wherein the body is formed immediately behind each web with a transverse fracture zone.

4. The sabot defined in claim 1 wherein at least the webs are of a synthetic resin.

5. The sabot defined in claim 1 wherein the pocket is annularly continuous and the ridge defines a radial outer wall of the pockets, whereby air trapped in the pocket presses the outer wall thereof radially outward.

6. The sabot defined in claim 1 wherein the webs project longitudinally forward and have respective forwardly and inwardly directed surfaces.

* * * * *

UNITED STATES PATENT AND TRADEMARK OFFICE

CERTIFICATE OF CORRECTION

PATENT NO. : 4,608,927

DATED : September 2, 1986

INVENTOR(S) : Rudolf ROMER ET AL

It is certified that error appears in the above-identified patent and that said Letters Patent are hereby corrected as shown below: On the Title Page:

Please add the name of the seventh named inventor:

—Patrick MONTIER, Bourges, France; --

Please add the name of the eighth named inventor:

—Jean-Claude SAUVESTRE, St. Doulchard, France. --

Signed and Sealed this

Twenty-sixth Day of January, 1988

*Attest:*

DONALD J. QUIGG

*Attesting Officer*

*Commissioner of Patents and Trademarks*